US011662120B2

(12) United States Patent
Zala et al.

(10) Patent No.: US 11,662,120 B2
(45) Date of Patent: May 30, 2023

(54) REDUCED SIZE FIRE TUBE BOILER SYSTEM AND METHOD OF OPERATING SAME

(71) Applicant: The Cleaver-Brooks Company, Inc., Thomasville, GA (US)

(72) Inventors: Rakesh Zala, Thomasville, GA (US); Steven L. Whirry, Thomasville, GA (US); Mark T. Salentine, Thomasville, GA (US)

(73) Assignee: The Cleaver-Brooks Company, Inc., Thomasville, GA (US)

( * ) Notice: Subject to any disclaimer, the term of this patent is extended or adjusted under 35 U.S.C. 154(b) by 0 days.

(21) Appl. No.: 16/142,988

(22) Filed: Sep. 26, 2018

(65) Prior Publication Data

US 2019/0162442 A1 May 30, 2019

Related U.S. Application Data

(63) Continuation of application No. 14/743,422, filed on Jun. 18, 2015, now abandoned.

(51) Int. Cl.

| | |
|---|---|
| ***F24H 1/20*** | (2022.01) |
| ***F24H 1/28*** | (2022.01) |
| ***F24H 9/00*** | (2022.01) |

(52) U.S. Cl.

CPC ..... *F24H 1/205* (2013.01); *F24H 1/285* (2013.01); *F24H 1/287* (2013.01); *F24H 9/0026* (2013.01); *F24H 9/0084* (2013.01)

(58) Field of Classification Search

CPC ..... F24H 1/205; F24H 1/287; F24H 1/285; F24H 9/0026; F24H 9/0084

(Continued)

(56) References Cited

U.S. PATENT DOCUMENTS

| | | | | |
|---|---|---|---|---|
| 438,872 | A | 10/1890 | Wilson et al. | |
| 1,151,127 | A * | 8/1915 | Schroder | F22B 7/12 122/149 |

(Continued)

FOREIGN PATENT DOCUMENTS

| | | |
|---|---|---|
| CN | 202902244 | 4/2013 |
| DE | 3832322 | 3/1990 |

(Continued)

OTHER PUBLICATIONS

Upcoming Projects Slides (FT Steam Boiler Premix, 80-300 HP, Dry Back) shared with CBRA members at Annual New Product Committee Meeting, Jun. 19, 2014, 2 pages.

(Continued)

*Primary Examiner* — Steven B McAllister
*Assistant Examiner* — Benjamin W Johnson
(74) *Attorney, Agent, or Firm* — Amundsen Davis, LLC

(57) ABSTRACT

A boiler system having a generally cylindrical housing or shell includes a main or fire tube with a furnace or combustion chamber extending longitudinally near the bottom of the housing and a burner to accomplish combustion within the combustion chamber. The combustion chamber opens at its rear end to furnace tube sheet, and to a first set of tubes extending longitudinally of the boiler. The first set of tubes extends to and through the rear tube sheet of the boiler to a turnaround space, which transitions to a second set of tubes located above the combustion chamber and first set of tubes to generally span a length extending from the rear tube sheet of the boiler to the front tube sheet. The boiler system as disclosed has a reduced size while maintaining efficiency in steam and hot water applications.

18 Claims, 5 Drawing Sheets

(58) Field of Classification Search
USPC ..... 122/18.3, 18.31, 13.01, 17.1, 17.2
See application file for complete search history.

(56) References Cited

U.S. PATENT DOCUMENTS

| | | | | |
|---|---|---|---|---|
| 1,945,418 | A | 1/1934 | Brandt | |
| 2,264,226 | A | 7/1940 | Toner | |
| 2,390,056 | A | 12/1945 | Cleaver et al. | |
| 3,033,269 | A | 5/1962 | Craig et al. | |
| 3,056,389 | A | 10/1962 | Gething | |
| 3,241,530 | A * | 3/1966 | Blockley | F22B 7/12 122/410 |
| 3,259,107 | A * | 7/1966 | Dalin | F24H 1/40 122/136 R |
| 3,262,429 | A | 7/1966 | Loebel | |
| 3,392,711 | A * | 7/1968 | Wolfersperger | F22B 33/08 122/52 |
| 3,793,994 | A | 2/1974 | Olsen | |
| 4,287,857 | A | 9/1981 | Schnitzer | |
| 4,659,305 | A * | 4/1987 | Nelson | F23C 9/08 431/115 |
| 5,666,944 | A | 9/1997 | Ferguson | |
| 6,558,153 | B2 | 5/2003 | Schutz et al. | |
| 6,971,336 | B1 * | 12/2005 | Chojnacki | F22B 7/12 122/149 |
| 8,784,096 | B2 | 7/2014 | Mosiewicz | |
| 2001/0046649 | A1 * | 11/2001 | Schutz | F23C 6/047 431/4 |

FOREIGN PATENT DOCUMENTS

| | | |
|---|---|---|
| GB | 1518909 | 7/1978 |
| JP | S52690 | 1/1977 |
| JP | S526901 | 1/1977 |

OTHER PUBLICATIONS

XPO Indirect Burner page, Industrial Burners, Combustion Equipment—Maxon Corporation; retrieved from url: https://www.maxoncorp.com/Directory/product/XPO-Burner-Low-NOx/443/, 1 page.

Office Action from the Mexican Institute of Industrial Property for Application No. MX/a/2017/016703 dated May 18, 2021 (including partial English Translation/Summary), 11 pages.

PCT/US2015/036451 International Search Report dated Feb. 17, 2016 (4 pages).

PCT/US2015/036451 International Preliminary Report on Patentability and Written Opinion of the International Searching Authority dated Dec. 19, 2017 (7 pages).

Examination Report from the Canadian Intellectual Property Office for Canada Application No. 2,989,805 dated Aug. 12, 2021 (7 pages).

* cited by examiner

REDUCED SIZE FIRE TUBE BOILER SYSTEM AND METHOD OF OPERATING SAME

FIELD

The present invention relates to boiler systems that employ combustion processes and, more particularly, to improved boiler systems for hot water and steam applications and associated methods of operation.

BACKGROUND

Boiler systems that employ combustion processes to generate heat are commonly employed in a variety of environments. Fire tube boilers or boiler furnaces typically have a combustion chamber encompassed within a vessel or water tank and a plurality of heat transfer tubes passing through the vessel for conducting heated or hot combustion gases resulting from combustion of an air-fuel mixture by a burner, typically located at the front of the boiler. The hot combustion gases are typically passed from the front of the boiler, to the rear, and back to the front. Additional passes, using additional tubes, are often provided within the boiler to accomplish complete heat exchange.

In other systems, multiple combustion stages, particularly by using multiple combustion chambers, are used to accomplish complete combustion. For example, see U.S. Pat. No. 6,971,336, which teaches a firetube boiler furnace having two combustion sections and an in-line intermediate tubular heat transfer section between the two combustion sections and integral to the pressure vessel. This design provides a staged oxidant combustion apparatus with separate in-line combustion chambers for fuel-rich primary combustion and fuel-lean secondary combustion and sufficient cooling of the combustion products from the primary combustion such that when the secondary combustion oxidant is added in the secondary combustion stage, the $NO_x$ formation is less than 5 ppmv at 3% $O_2$.

It has been found the prior systems, such as the kind noted above, while capable of providing benefits, also can have drawbacks, including significant complexity, and relatively high costs of production, installation and/or maintenance. Moreover, such prior systems can take up a rather large area, or "footprint," and have a relatively large size, creating complexity at during installation, particularly in instances in which space is limited and/or access is difficult.

In view of one or more such limitations that exist in relation to conventional fire tube boiler systems, it would be advantageous if improvements could be achieved in relation to such boiler systems and related methods of operation.

SUMMARY

The present disclosure, in at least some embodiments, relates to a boiler system that includes a burner and a housing having a generally cylindrical shape and extending between first and second walls to provide a generally cylindrical space. Further, a fire tube is positioned near a bottom of the generally cylindrical space the fire tube and extends longitudinally from a first wall of the cylindrical housing to a fire tube end wall, with the fire tube providing a combustion chamber where combustion of an air-fuel mixture is accomplished using the burner. Additionally, a first set of tubes is located within the housing, with the tubes of the first set extending longitudinally from and parallel with the end of the fire tube to the second wall of the housing, and a second set of tubes is located above and about a portion of the fire tube and a portion of the first set of tubes, with the tubes of the second set of tubes generally spanning a length extending between the first and the second walls of the cylindrical housing. A chamber providing a space between and connecting the first and second sets of tubes is provided as well, and heated or hot combustion gases flow from the fire tube to the first set of tubes, through the chamber space, and to the second set of tubes. The boiler system can be configured for use with steam and hot water applications.

Other embodiments are contemplated and considered to be within the scope of the present disclosure.

BRIEF DESCRIPTION OF THE DRAWINGS

Features of the present disclosure which are believed to be novel are set forth with particularity in the appended claims. Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings:

DETAILED DESCRIPTION

Figure 1:
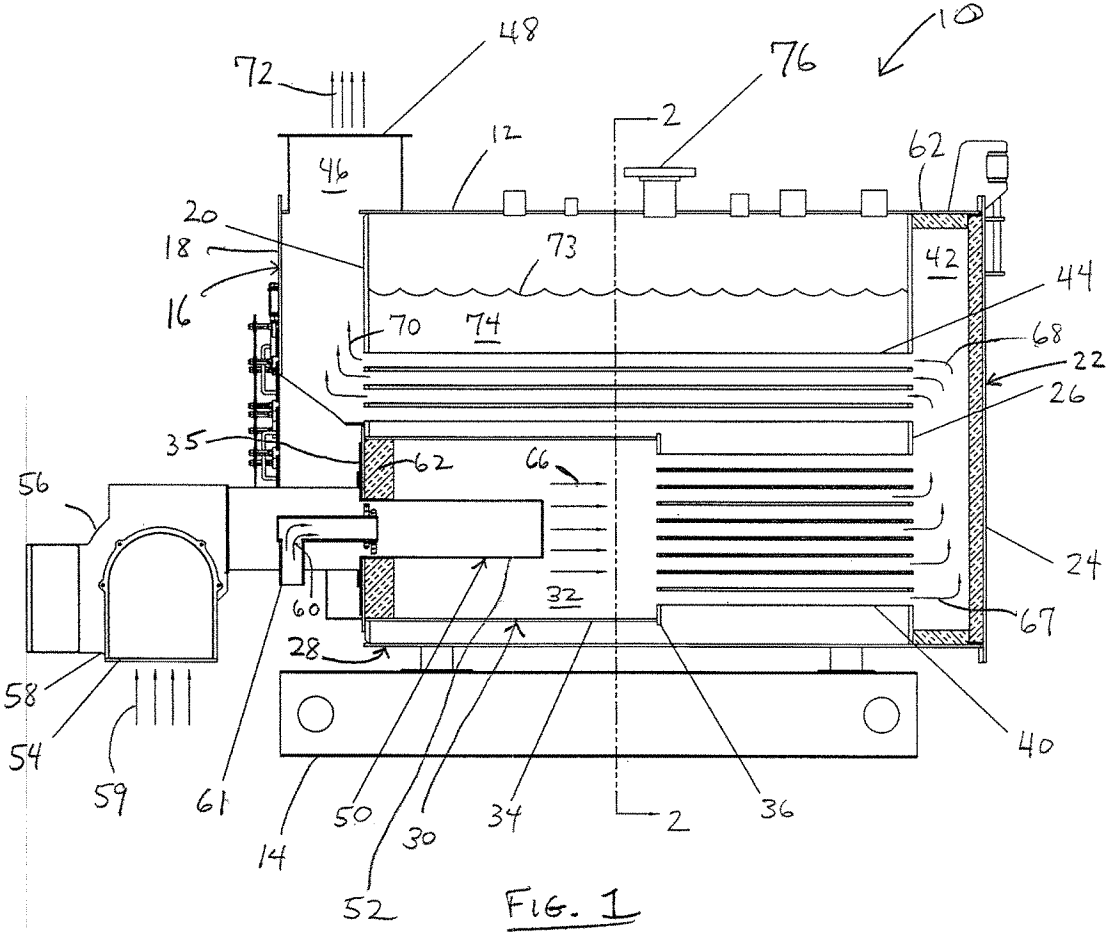
FIG. 1 is a schematic diagram of a boiler system in accordance with one example embodiment encompassed herein.
Figure 2:
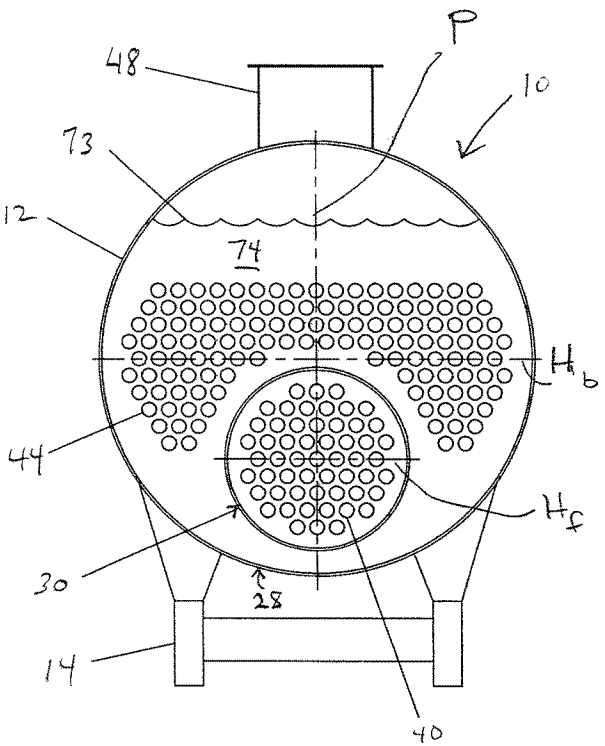
FIG. 2 is a sectional view taken at about line 2-2 of FIG. 1.

FIG. 1 shows a schematic diagram of a boiler system (or "boiler"), generally referenced by numeral 10, in accordance with one example embodiment encompassed herein, and FIG. 2 is a sectional view taken at about line 2-2 of FIG. 1. With reference to these Figures, the boiler 10 employs, in accordance with at least some embodiments, a housing or shell 12 with, as shown in the present embodiment, a generally cylindrical shape, and includes a circumference, and is mounted upon an appropriate base structure 14. At or near its front end 16 (FIG. 1), the boiler 10 is formed or otherwise provided with an outer front end wall 18 (FIG. 1) and an inner front end wall 20 (FIG. 1), which can in at least some embodiments take the form of a tube sheet, spaced longitudinally of the boiler with respect to the outer front end wall. Similarly, at or near its rear end 22 (FIG. 1), the boiler is formed or otherwise provided with an outer rear end wall 24 (FIG. 1) and an inner rear end wall 26 (FIG. 1) and which again can in at least some embodiments take the form of a tube sheet. As described further below, the shell 12, together with the inner front and rear end walls 20, 26 form the substantially tank or vessel that contains water that is to be heated.

Extending longitudinally (and as shown horizontally) of the boiler 10 and generally mounted within the shell 12 and generally near its bottom 28 is a main or fire tube or furnace 30, which provides a combustion chamber 32 (FIG. 1). The combustion chamber 32 is generally bounded by a shell structure 34, which in the present embodiment takes a cylindrical shape having a circumference. The shell structure 34 extends longitudinally from the front furnace end wall 35 which, in the present embodiment is a portion of the front inner end wall 20, and to a furnace end wall, 36 (FIG. 1), where the rear end wall 36 can, in at least some embodiments, take the form of a tube sheet.

At or near its front end wall 35, the fire tube 30 opens to accommodate a burner 50 (FIG. 1), described in greater detail herein. At or near its rear end wall 36, the fire tube 30 extends and opens to a first set of tubes, generally referenced by numeral 40, which are located, in the embodiment illustrated, rearward of the fire tube and which further extend longitudinally (and as shown horizontally) of the boiler 10. In other words, the tubes of the first set of tubes 40 extend to be contained within the circumference of the shell structure 34 when viewing the sectional views of FIGS. 2 and 4, or contained within a projection of the circumference of the shell structure longitudinally. The first set of tubes 40 further extend to and through the inner rear end wall 26 to a turnaround space 42 (FIG. 1) between the rear outer and inner end walls 24, 26, respectively, of the boiler 10. In accordance with at least some embodiments, the rear outer end wall 24 is constructed so that it can be opened, for example as a hinged door, to permit access to the turnaround space 42 and other features or structures of the boiler 10, and thus in at least such embodiments can be described as an access door.

Also extending longitudinally (and as shown horizontally) of the boiler 10 is a second set of tubes, generally referenced by numeral 44, located generally above the fire tube 30 and above the first set of tubes 40, and generally span a length extending from the inner rear end wall 26 to the inner front end wall 20. Moreover, the second set of tubes 44 are open to a space forward of the front inner end wall of the boiler, generally referenced by number 46 (FIG. 1), which space provides access to an exhaust or stack outlet 48.

In accordance with at least some embodiments, the shell structure 34 of the furnace 30 is centered with respect to the housing 12 of the boiler system 10 with respect to a vertical plane P, and the tubes of the first set of tubes and the tubes of the second set of tubes are symmetrically positioned with respect to the vertical plane P. Moreover, in accordance with at least some embodiments, the shell structure 34 of the furnace 30 is positioned with respect to the housing 12 of the boiler system 10 such that the shell structure of the furnace, and all of the tubes of the first set of tubes 40 are below a horizontal plane H of the housing 12 of the boiler system 10. Finally, the tubes of the second set of tubes are circumferentially disposed about the shell structure of the furnace (and therefore the tubes of the first set of tubes) such that they are located above a horizontal plane $H_f$ of the shell structure 34 of furnace 30. The second set of tubes 44 is disposed symmetrically with respect to the vertical plane P of the boiler housing 12 of the boiler 10.

The burner 50 (FIG. 1) is provided to accomplish combustion within the main tube 30. In at least some embodiments, the burner 50 can take the form an air-fuel burner having a burner head 52 (FIG. 1) often taking the form of a cylinder adapted to receive a combustible air-fuel mixture. Air for the air-fuel mixture is provided by way of: an air inlet 54 (FIG. 1) formed in a housing 56 (FIG. 1), which includes or provides for a damper 58 (FIG. 1) for opening or closing the air inlet to selectively provide an air flow, indicated by arrows 59 (FIG. 1). Fuel, such as gas (e.g., natural gas) is provided, as indicated by arrows 60, to the burner 50 from a fuel source (not shown) by way of a fuel inlet 61. In accordance with at least some embodiments, the burner 50 can be described as a "pre-mix" burner. In the embodiment illustrated in FIGS. 1 and 2, burner 50 the takes the form of a "gun" style burner arrangement. It is contemplated that, in at least some embodiments, the burner head 52 is configured to discharge the combustible air-fuel mixture into the combustion chamber. The discharged combustible air-fuel mixture is ignited to produce a flame in the combustion chamber 32.

In at least some embodiments, and as shown (in FIG. 1), the burner head 52 is incorporated or provided with respect to the main or fire tube 30 by mounting the burner 50 to the main or fire tube front wall 35, so that the burner head extends into the main or fire tube. With this arrangement, the combustion chamber 32 is at least in some sense integrated with and used as part of the burner 50.

Figure 3:
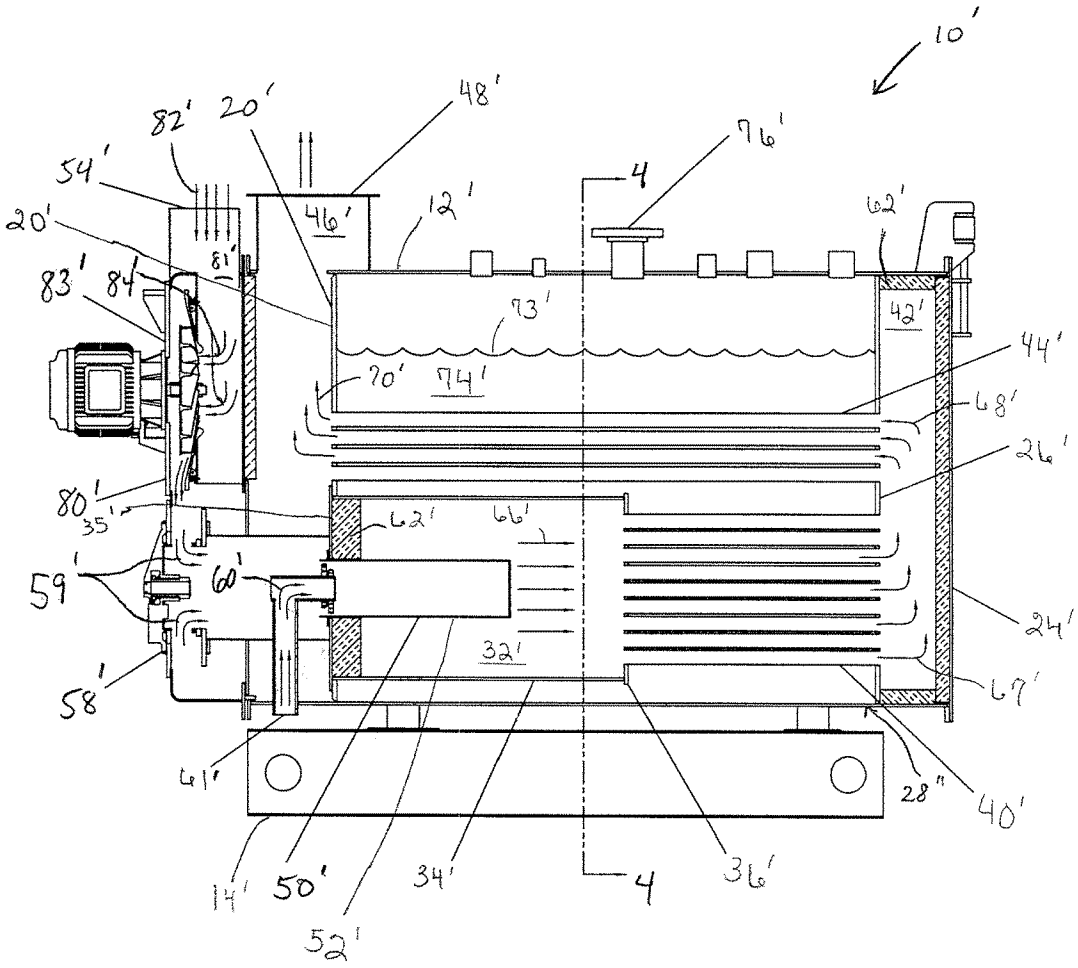
FIG. 3 is a schematic diagram of boiler system, similar to the boiler system of FIG. 1 but showing an alternative burner arrangement, in accordance with one example embodiment encompassed herein.
Figure 4:
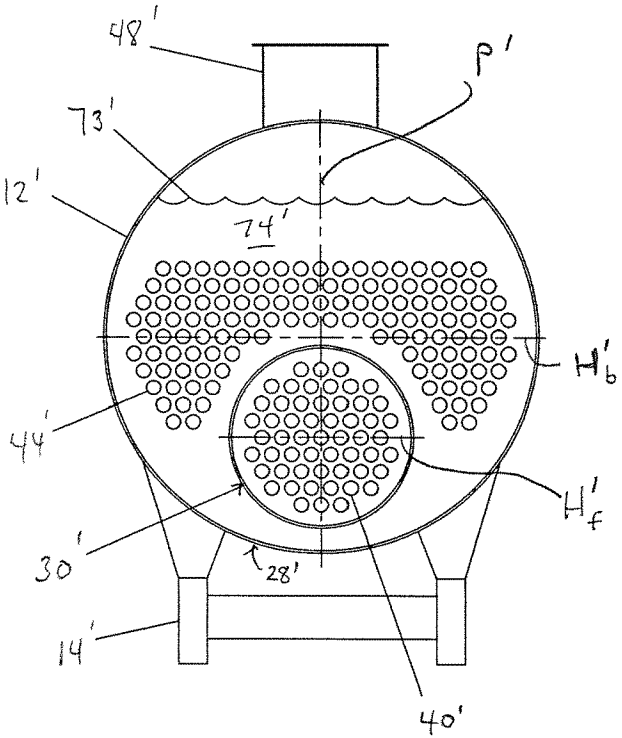
FIG. 4 is a sectional view taken along line 4-4 of FIG. 3.

In a further embodiment, as shown in FIGS. 3 and 4, with FIG. 4 being a sectional view taken at about line 4-4 of FIG. 3, the boiler 10' includes an integrated burner 50' that is integrally provided with the boiler system. More particularly, as shown, boiler 10' includes an additional front housing or head portion 80' in which the burner 50' is provided and which an air passage 81' is provided. Air for the air-fuel mixture is provided, indicated by arrows 82', by way of: an air inlet 54' (FIG. 3) formed or provided in the front housing 80' (FIG. 3). The air is drawn, via a combustion air fan 83' (FIG. 3) and as shown by arrows 84', towards the damper 58' (FIG. 3) via the passage 81'. The damper 58' provides again for opening or closing of the air inlet 54', or more generally the air passage 81', to selectively provide an air flow, indicated by arrows 59' (FIG. 3). Fuel, such as gas (e.g., natural gas) is provided, as indicated by arrows 60', to the burner 50' from a fuel source (not shown) by way of a fuel inlet 61'. In accordance with at least some embodiments, the burner 50 can again be described as a "pre-mix" burner. In general, the overall components of the boiler system 10' are similar or the same as those provided with respect to FIGS. 1 and 2. Like parts are labeled with like numbers.

Also as shown, with reference to FIGS. 1-4, various regions of the boiler 10/10', including over portions of its outer housing 12/12' (e.g., as shown at and near its rear outer wall 26/26'), is provided with insulation 62/62' (FIGS. 1 and 3). Additionally, as shown, the fire tube 30/30', is, over a portion of its length, provided with an insulation 64/64' that surrounds a portion of the burner head 52/52'.

In accordance with embodiments of the present disclosure, the main or fire tube 30/30' provides for complete combustion of heated gases, as well as passage of such heated gases to the first set of tubes 40/40' rearward of the fire tube, with such passage or flow indicated by arrows 66/66'. The first set of tubes 40/40' provide for further passage of the heated gases to the turnaround space 42/42', with such flow indicated by arrows 67/67' and then to the second set of tubes 44/44' located, as shown, above or vertically in relation to the first set of fire tubes, which such flow indicated by arrows 68/68'. The second set of tubes provide for further passage of heated gases in to the space 46/46', and then to the exhaust 48/48', as indicated by arrows 70/70', where the gases are discharged, as indicated by arrows 72/72'.

As shown in FIGS. 1 and 2, as well as FIGS. 3 and 4, in accordance with at least some embodiments of the present disclosure, the boiler 10/10' is provided for use with a steam application. The second set of tubes 44/44' are positioned within the boiler shell 12/12' so that they are spaced circumferentially about or around an upper portion of the fire tube 30/30'. The second set of tubes 44/44', together with the fire tube 30/30' and the first set of tubes 40/40', are positioned below a level 73/73' of water 74/74' that that is contained within the shell, and thus are completed submerged in water. The water is heated for use in other applications. Additionally and as shown, the second set of tubes 44/44' are positioned and oriented or disposed adjacent one another and to create additional space for steam that is created due to heat transfer from the first and second sets of tubes 40/40', 44/44' to the water 74/74'. Controlled discharge of such steam can be discharged via the outlet (e.g., steam outlet) 76/76'.

Figure 5:
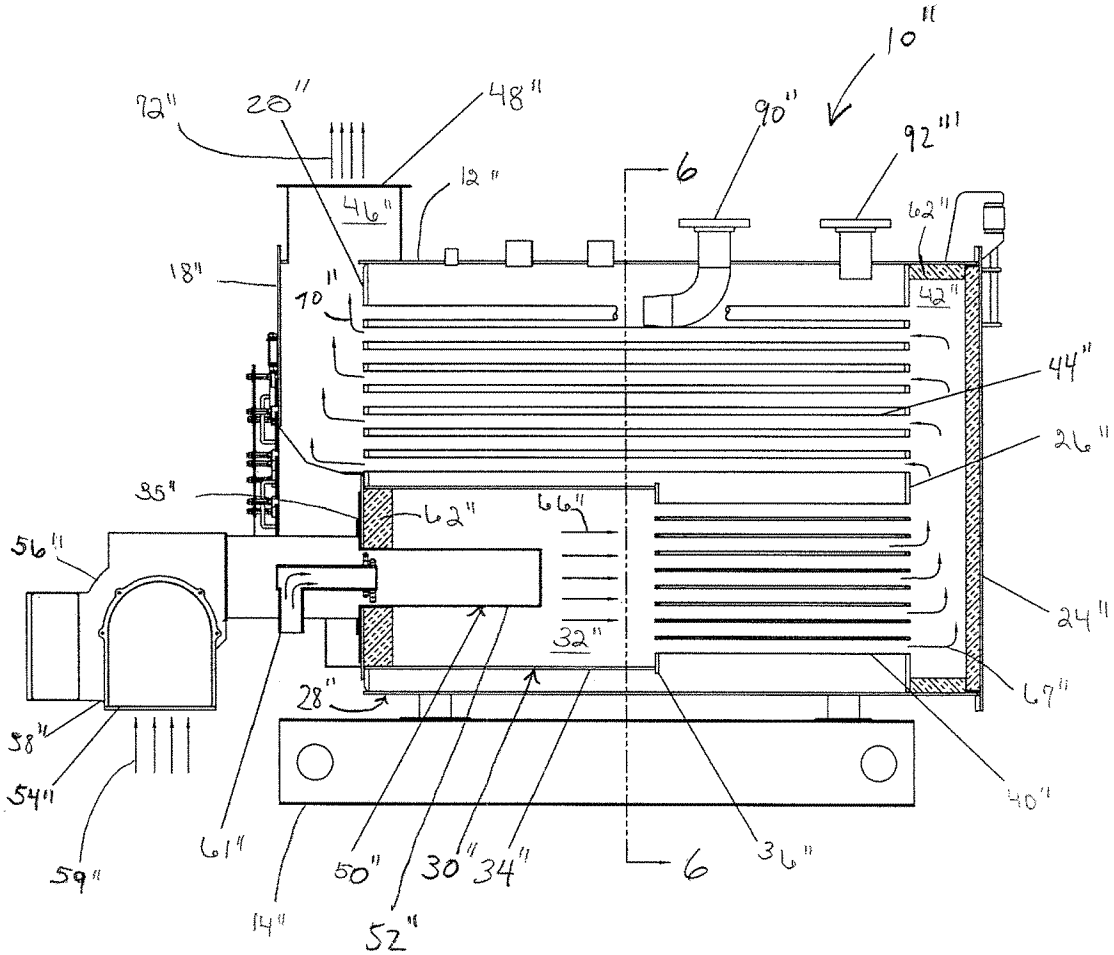
FIG. 5 is a schematic diagram of a boiler system in accordance with another example embodiment encompassed herein.
Figure 6:
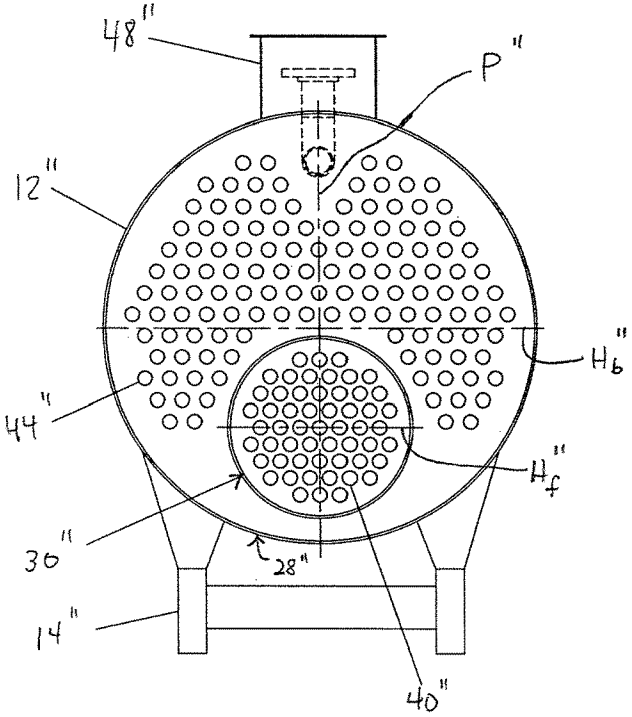
FIG. 6 is a sectional view taken along line 6-6 of FIG. 5.
Figure 7:
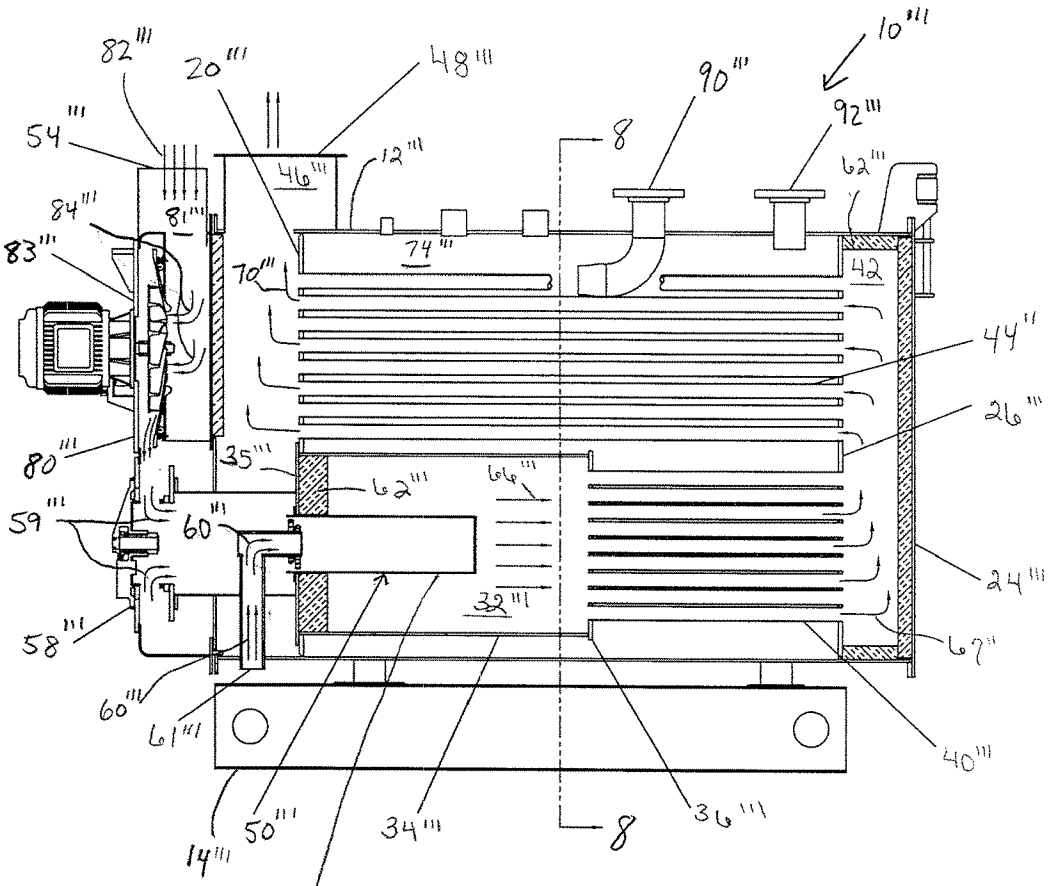
FIG. 7 is a schematic diagram of boiler system, similar to the boiler system of FIG. 5, but showing an alternative burner arrangement, in accordance with one example embodiment encompassed herein.
Figure 8:
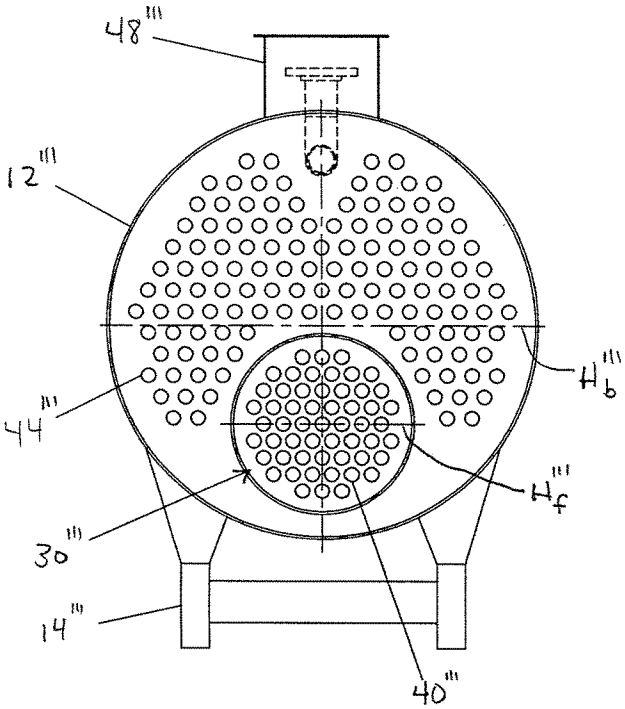
FIG. 8 is a sectional view taken along line 8-8 of FIG. 7.

FIG. 5 is a schematic diagram of a boiler system 10" in accordance with another example embodiment encompassed herein and FIG. 6 is a sectional view taken along line 6-6 of FIG. 5 and having a burner 50" similar to the burner 50 of FIGS. 1 and 2. FIG. FIG. 7 is a schematic diagram of boiler system 10''', similar to the boiler system 10" of FIG. 5, but showing an alternative burner 50''' (similar to the burner arrangement of FIGS. 3 and 4), in accordance with one example embodiment encompassed herein. FIG. 8 is a sectional view taken along line 8-8 of FIG. 7.

With reference to these Figures, the boiler 10"/10''' employs, in accordance with at least some embodiments, a housing or shell 12"/12''' with, as shown in the present embodiment, a generally cylindrical shape, and includes a circumference, and is mounted upon an appropriate base structure 14"/14'''. At or near its front end 16"/16''' (FIGS. 5 and 7), the boiler 10"10''' is formed or otherwise provided with an outer front end wall 18"18''' (FIGS. 5 and 7) and an inner front end wall 20"/20''' (FIGS. 5 and 7), which can in at least some embodiments take the form of a tube sheet, spaced longitudinally of the boiler with respect to the outer front end wall. Similarly, at or near its rear end 22"22''' (FIGS. 5 and 7), the boiler is formed or otherwise provided with an outer rear end wall 24"/24''' (FIGS. 5 and 7) and an inner rear end wall 26"/26''' (FIGS. 5 and 7) and which again can in at least some embodiments take the form of a tube sheet. As described further below, the shell 12"/12''', together with the inner front and rear end walls 20"/20''', 26"/26''' form the substantially tank or vessel that contains water that is to be heated.

Extending longitudinally (and as shown horizontally) of the boiler 10"/10''' and generally mounted within the shell 12"/12''' and generally near its bottom 28"/28''' is a main or fire tube or furnace 30"/30''', which provides a combustion chamber 32"/32''' (FIGS. 5 and 7). The combustion chamber 32"/32''' is generally bounded by a shell structure 34"/34''', which in the present embodiment takes a cylindrical shape having a circumference. The shell structure 34"/34''' extends longitudinally from the front furnace end wall 35"/35''' which, in the present embodiment is a portion of the front inner end wall 20"/20''', and to a furnace end wall, 36"/36''' (FIGS. 5 and 7), where the rear end wall 36"/36''' can, in at least some embodiments, take the form of a tube sheet.

At or near its front end wall 35"/35''', the fire tube 30"/30''' opens to accommodate a burner 50"/50''' (FIGS. 5 and 7), described in greater detail herein. At or near its rear end wall 36"/36''', the fire tube 30"/30''' extends and opens to a first set of tubes, generally referenced by numeral 40"/40''', which are located, in the embodiment illustrated, rearward of the fire tube and which further extend longitudinally (and as shown horizontally) of the boiler 10"/10'''. In other words, the tubes of the first set of tubes 40"/40''' extend to be contained within the circumference of the shell structure 34"/34''' when viewing the sectional views of FIGS. 6 and 8, or contained within a projection of the circumference of the shell structure longitudinally. The first set of tubes 40"/40''' further extend to and through the inner rear end wall 26"/26''' to a turnaround space 42"/42''' (FIGS. 5 and 7) between the rear outer and inner end walls 24"/24''', 26"/26''', respectively, of the boiler 10"/10'''. In accordance with at least some embodiments, the rear outer end wall 24"/24''' is constructed so that it can be opened, for example as a hinged door, to permit access to the turnaround space 42"/42''' and other features or structures of the boiler 10"/10''', and thus in at least such embodiments can be described as an access door.

Also extending longitudinally (and as shown horizontally) of the boiler 10"/10''' is a second set of tubes, generally referenced by numeral 44"/44''', located generally above the fire tube 30"/30''' and above the first set of tubes 40"/40''', and generally span a length extending from the inner rear end wall 26"/26''' to the inner front end wall 20"/20'''. Moreover, the second set of tubes 44"/44''' are open to a space forward of the front inner end wall of the boiler, generally referenced by number 46"/46''' (FIGS. 5 and 7), which space provides access to an exhaust or stack outlet 48"/48'''.

In accordance with at least some embodiments, the shell structure 34"/34''' of the furnace 30"/30''' is centered with respect to the housing 12"/12''' of the boiler system 10"/10''' with respect to a vertical plane P"/P'''', and the tubes of the first set of tubes and the tubes of the second set of tubes are symmetrically positioned with respect to the vertical plane P"/P'''. Moreover, in accordance with at least some embodiments, the shell structure 34"/34''' of the furnace 30"/30''' is positioned with respect to the housing 12"/12''' of the boiler system 10"/10''' such that the shell structure of the furnace, and all of the tubes of the first set of tubes 40"/40''' are below a horizontal plane H"/H'''' of the housing 12"/12''' of the boiler system 10"/10'''. Finally, the tubes of the second set of tubes are circumferentially disposed about the shell structure of the furnace (and therefore the tubes of the first set of tubes) such that they are located above a horizontal plane $H_f''/H_f'''$ of the shell structure 34"/34''' of furnace 30"/30'''. The second set of tubes 44"/44''' is disposed symmetrically with respect to the vertical plane P"/P'''' of the boiler housing 12"/12''' of the boiler 10"/10'''.

The burner 50"/50''' (FIGS. 5 and 7) is provided to accomplish combustion within the main tube 30"/30'''. In at least some embodiments, the burner 50"/50''' can take the form an air-fuel burner having a burner head 52"/52''' (FIGS. 5 and 7) often taking the form of a cylinder adapted to receive a combustible air-fuel mixture. Air for the air-fuel mixture is provided by way of: an air inlet 54"/54''' (FIGS. 5 and 7) formed in a housing 56"/56''' (FIGS. 5 and 7), which includes or provides for a damper 58"/58''' (FIGS. 5 and 7) for opening or closing the air inlet to selectively provide an air flow, indicated by arrows 59"/59'" (FIGS. 5 and 7). Fuel, such as gas (e.g., natural gas) is provided, as indicated by arrows 60"/60'", to the burner 50"/50'" from a fuel source (not shown) by way of a fuel inlet 61"/61'". In accordance with at least some embodiments, the burner 50"/50'" can be described as a "pre-mix" burner.

In accordance with these embodiments, the respective boiler systems 10"/10'", respectively, are provided for use with a hot water application. Accordingly, it is contemplated that the boilers 10"/10'", and particularly each of the respective shells 12"/12'", are completely, or at least substantially completely filled (or "flooded") with water 74 during operation, and so no level of water is indicated, as was shown in FIGS. 1-4. Water typically exits (for use in various applications) via outlet 92"/92'" and/or is replenished (as the water is used) via inlet 90"/90'" (FIGS. 5, 7). As shown in FIGS. 5-8, the second set of tubes 44"/44'", respectively, are positioned within the boiler shell 12",/12'" respectively, so that the tubes are spaced about or around an upper portion of the fire tube 30"/30'", respectively, and are disposed throughout a substantial portion of the space above the respective fire tube 30"/30'". Stated another way, the respective second set of tubes 44"/44'" is not contained below a level of water, as discussed in reference to the embodiment described in FIGS. 1-4 and the tubes of the respective second set of tubes 44"/44'" now are positioned to extend within an uppermost region of the shell 12"/12'".

With further reference to FIGS. 5 and 6, an exemplary boiler 10" is shown for use for a water application. With the exception of the arrangement of the second set of tubes 44", as described above, the remaining structures of the boiler 10" are consistent with those described with reference to FIGS. 1 and 2, above, with like reference numbers referring to like structures. Similarly, with reference to FIGS. 7 and 8, an exemplary boiler system 10'" is shown for use with a water application. With the exception of the arrangement of the second set of tubes 44'", as described above, the remaining structures of the boiler 10'" are consistent with those described with reference to FIGS. 3 and 4, above, with like reference numbers referring to like structures.

One burner type or style that is contemplated for use, or contemplated to be adapted for use, in regard to embodiment(s) of the boiler 10/10'/10"/10'" of the present disclosure is the XPO™ Indirect burner, available from Maxon Corporation, located at 201 East 18th Street, Muncie, Ind. 47302. In such embodiments, various features of the burner 50/50'/50"/50'" can take a specific form, for example, the burner head 52/52'/52"/52'" can take the form of an air-fuel nozzle. Additional details regarding at least some embodiments of burners, such as the XPO™ Indirect burner, that can be used in accordance with at least some embodiments of the present disclosure are provided in U.S. Pat. No. 8,784,096, entitled "Low NOx Indirect Fire Burner", the entirety of the teachings of which are incorporated by reference herein. In other embodiments, the burner 52/52'/52"/52'" can take on other styles or forms, for instance a burner of the fiber mesh style (not shown), where the burner head can take the form of a burner canister, or surface burner.

In accordance with embodiments of the present disclosure, it is contemplated that the tubes making up the first and second sets of tubes 40/40'/40"/40'" and 44/44'/44"/44'", respectively, can comprise any of a variety of tubes including by way of example, plain tubes, plain tubes with extended heating surface, and rifled tubes that are generally known. One example of rifled tubes currently available and known is X-ID® tubes, available from Tektube, located at 555 West. 41st Street, Tulsa, Okla., 74107. Another example of tubes suitable for use in relation to embodiments of the present disclosure are aluFer® tubes, available from Hoval Aktiengesellschaft Austrasse 70, 9490 Vaduz Liechtenstein. In at least some embodiments, the tubes can comprise cylindrical smooth outer-walled outer tubes of steel into which profiled inserts made of aluminum, and having ribs, may be inserted, such as of the kind described in a in U.S. Pat. No. 6,070,657, entitled "Heat Exchanger Tube for Heating Boilers", the entirety of the teachings of which are incorporated by reference herein. In other embodiments, it is contemplated that the tubes can take on other styles or forms. Other tube types are contemplated and considered within the scope of the present disclosure.

Figure 9:
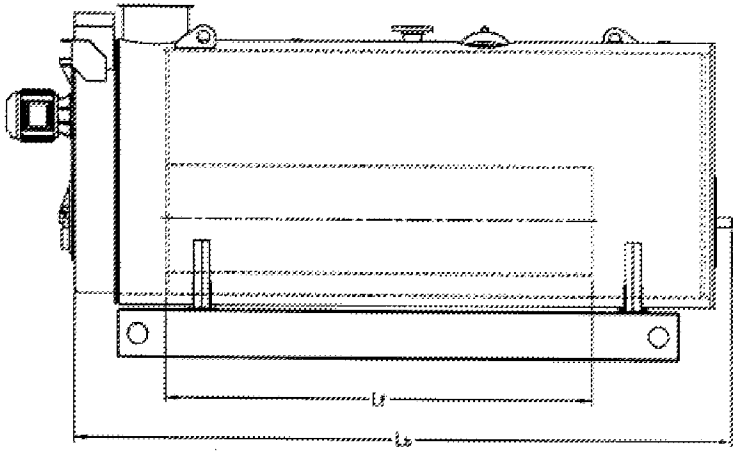
FIG. 9 (PRIOR ART)
FIG. 9 is a diagrammatic illustration of a prior boiler system showing typical furnace lengths $L_f$ and typical boiler lengths, $L_b$, of such a prior boiler system; and, FIG. 10 is a diagrammatic illustration of a new boiler system provided in accordance with embodiments of the present disclosure, and showing typical furnace lengths $L_{nf}$ and typical boiler lengths, $L_{nb}$ of such boiler systems.
Figure 10:
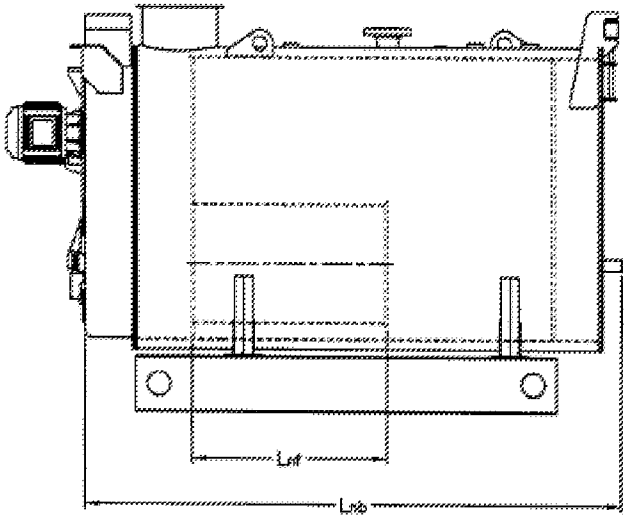

FIG. 9A is a diagrammatic illustration of a prior boiler system 100 showing typical furnace lengths $L_f$ and typical boiler lengths, $L_b$, of such a prior boiler system. A typical prior boiler system 100 is available, for example, as CleaverBrooks' CBEX Elite boiler. FIG. 9B is a is a diagrammatic illustration of a new boiler system 110 provided in accordance with embodiments of the present disclosure, including by way of example, those depicted and described in one or more of FIGS. 1-8, and showing typical furnace lengths $L_{nf}$ and typical boiler lengths, $L_{nb}$ of such boiler systems. Table A, below, indicates typical furnace and boiler lengths for boiler systems 100 of the prior design (FIG. 9), as well as the reduced furnace and boiler lengths, respectively, for boiler systems 110 provided in accordance with exemplary embodiments of the present disclosure (FIG. 10).

TABLE A

Furnace and Boiler Lengths

| Boiler Horsepower | New Design Furnace Length $L_{nf}$ (inch) | Typical Prior Designs* Avg Furnace Length $L_f$ (inch) | New Design Boiler Length $L_{nb}$ (inch) | Typical Prior Designs* Boiler Length $L_b$ (inch) |
|---|---|---|---|---|
| 100 | 57 | 95 | 139 | 156 |
| 125 | 57 | 102 | 139 | 163 |
| 150 | 59 | 106 | 141 | 167 |
| 200 | 59 | 125 | 141 | 186 |
| 250 | 59 | 150 | 144 | 214 |
| 300 | 59 | 158 | 144 | 222 |
| 350 | 63 | 170 | 148 | 232 |
| 400 | 63 | 179 | 148 | 241 |
| 500 | 65 | 182 | 151 | 245 |
| 600 | 65 | 197 | 151 | 260 |
| 700 | 72 | 206 | 158 | 269 |
| 800 | 72 | 213 | 158 | 276 |

*Typical prior design lengths taken from CleaverBrooks' CBEX Elite boiler

In accordance with embodiments of the present disclosure, and as noted above with references to the Figures, tubes of the second set of tubes 44/44'/44"/44'" are circumferentially disposed about the shell structure 12/12'/12"/12'" of the furnace 30/30'/30"/30'" (and therefore the tubes of the first set of tubes 40/40'/40"/40'") such that they are located above a horizontal plane $H_f/H_f'/H_f''/H_f'''$ of the shell structure 34/34'/34"/34'" of furnace 30/30'/30"/30'". It is of further note that, as the boiler horsepower increases (e.g., up to 800 horsepower), it has been found that, in at least some embodiments, the number of tubes also increases and the boiler is packed much tighter with tubes, or stated another way, the spacing between respective tubes is more compressed. Moreover, it has been found that at least some of the tubes of the second set of tubes 44/44'/44"/44'" on such larger horsepower boilers are located below the horizontal plane $H_f/H_f'/H_f''/H_f'''$ and may be considered as being located below a portion the fire tube.

Advantageously, disclosed in accordance with at least some embodiments of the present disclosure, is a means for providing a boiler system with a reduced size while maintaining efficiency. In accordance with at least some embodiments, the boiler comprises a tank for a supply of water to be heated. Within the lower portion of the tank, a combustion chamber is provided, having a burner assembly mounted at one end. The chamber is terminated short of the opposite end of the water tank and has a series of smoke or fire tubes to direct the combustion products through the water to a manifold at the tank end. The manifold directs the combustion products back through tubes into the water tank, generally mounted about the combustion chamber, to an exhausting manifold at the burner end of the tank.

Advantageously, the boiler and/or the burner-boiler system, when compared to conventional systems, has a reduced size or "footprint," and so is better suited for a smaller boiler room, or other location where space is a substantial constraint.

Boiler systems provided in accordance with embodiments of the present disclosure, achieve 9 ppmv $NO_x$ formation at 3% $O_2$. In still further embodiments, the system achieves 5 ppmv $NO_x$ at 3% $O_2$.

Moreover, boiler systems provided in accordance with the present disclosure do not require two (or multiple) combustion stages or sections in order to accomplish complete combustion of the air-fuel mixture, let alone such two (or multiple) sections having one zone that may be considered as "fuel rich" and another that may be considered as "fuel lean."

A boiler system may comprise two or more embodiments described herein. Any reference to orientation (e.g., horizontal, vertical, upper, lower, front, rear, and the like) is made with reference to the specific drawing for teaching purposes only and should not be considered limiting.

In accordance with at least some embodiments of the present disclosure, a boiler system is provided that comprises: a burner; a housing having a generally cylindrical shape and extending between first and second walls to provide a generally cylindrical space; a fire tube positioned near a bottom of the generally cylindrical space the fire tube and extending longitudinally from a first wall of the cylindrical housing to a fire tube end wall, the fire tube providing a combustion chamber where combustion of an air-fuel mixture is accomplished using the burner; a first set of tubes located within the housing and extending longitudinally from and parallel with the end of the fire tube to the second wall of the housing, and a second set of tubes located above and about a portion of the fire tube and a portion of the first set of tubes, the second set of tubes generally spanning a length extending between the first and the second walls of the cylindrical housing; and a chamber providing a space between and connecting the first and second sets of tubes; and wherein heated combustion gases flow from the fire tube to the first set of tubes, through the chamber space, and to the second set of tubes.

In accordance with at least some embodiments of the present disclosure, the fire tube includes a shell structure comprising a generally cylindrical shape having a circumference and the first set of tubes extends in-line with the fire tube.

In accordance with at least some embodiments of the present disclosure, the housing includes a circumference and the second set of tubes extends at least partially about the shell structure.

In accordance with at least some embodiments of the present disclosure, a vertical plane passing through a center of the housing also passes through a center of the fire tube and the first and second sets of tubes are each positioned generally symmetrically on either side of the vertical plane.

In accordance with at least some embodiments of the present disclosure, at least one of: (a) none of the tubes of the second set of tubes extend in a region or location that is below any portion of the fire tube, and (b) none of the tubes of the second set of tubes extend in a region or location that is below any portion of the tubes of the first set of tubes.

In accordance with at least some embodiments of the present disclosure, none of the tubes of the second set of tubes extend in a region or location that is between the fire tube and the bottom of the cylindrical housing.

In accordance with at least some embodiments of the present disclosure, the flow of heated combustion gases is sequential such that the heated gases flow from the fire tube directly to and through the first set of tubes, and then directly to and through the chamber space, and then directly to and through the second set of tubes, before the heated combustion gases are discharged from the boiler.

In accordance with at least some embodiments of the present disclosure, the second set of tubes and the first set of tubes are submerged in water.

In accordance with at least some embodiments of the present disclosure, either: (a) water is provided within the housing to a water level, providing space open space to remain within the housing and permitting the boiler to be configured for steam applications; or (b) water is provided within the housing so that the housing is filled with water and the boiler is configured for hot water applications.

In accordance with at least some embodiments of the present disclosure, the first set of tubes comprises one or more plain tubes, one or more plain tubes with an extended heating surface, or one or more rifled tubes, and where in the second set of tubes comprises one or more plain tubes, one or more plain tubes with an extended heating surface, or one or more rifled tubes.

In accordance with at least some embodiments of the present disclosure, the burner is integrated with respect to the fire tube.

In accordance with at least some embodiments of the present disclosure, the burner is integrally formed with the housing.

In accordance with at least some embodiments of the present disclosure, combustion of the air-fuel mixture is completed within the combustion chamber, which is the only combustion chamber.

In accordance with at least some embodiments of the present disclosure, the air provided with for use with the air-fuel mixture is provided from a single source.

In accordance with at least some embodiments of the present disclosure, there is no device provided within the chamber providing the space between and connecting the first and second sets of tubes, that is configured to close any portion or end of any of the tubes in the first set of tubes or any of the tubes in the second set of tubes.

In accordance with at least some embodiments of the present disclosure, there is no device provided within the chamber providing the space between and connecting the first and second sets of tubes, that is configured to reverse the flow of any portion of the heated gases in any of the tubes in the first set of tubes, or any of the tubes in the second set of tubes.

Notwithstanding the above description, it should be appreciated that the present disclosure is intended to encompass numerous other systems, arrangements, and operational processes in addition to those descripted above. In reference to the preceding paragraphs and the aforementioned figures, although various embodiments of the present invention have been described above, it should be understood that embodiments have been presented by way of example, and not limitation. A person of ordinary skill in the art will recognize that there are various changes that can be made to the present invention without departing from the spirit and scope of the present invention. Therefore, the invention should not be limited by any of the above-described example embodiments, but should be defined only in accordance with the following claims and equivalents of the claimed invention presented herein.

The invention claimed is:

1. A boiler system comprising:

a housing having a generally cylindrical shape and extending a length between first and second walls of the housing to provide a generally cylindrical space, a head portion that includes a front housing and includes an air inlet and an air passage that provides air for an air-fuel mixture, wherein the air is drawn by a combustion air fan through the air inlet and is directed through the air passage;

a fire tube positioned substantially within the generally cylindrical space, the fire tube having a shell structure extending longitudinally from a fire tube front wall at the first wall of the housing a portion of the length between the first and second walls of the housing to a fire tube end wall, wherein the fire tube has a length that is less than half of the length of the housing of the boiler system, the fire tube providing a combustion chamber bounded by the shell structure, which is the only combustion chamber, wherein the combustion chamber comprises an interior space extending over a length that is at least substantially the entire extent of the length of the fire tube such that complete combustion of an air-fuel mixture is accomplished within the combustion chamber;

a burner, wherein the burner is mounted to the fire tube front wall, the burner having a burner head that extends from the fire tube front wall into the combustion chamber so as to discharge the air-fuel mixture into the combustion chamber, wherein there is space between the burner head and the combustion chamber in the radial direction of the burner head, wherein the fuel is a gas, and wherein the air-fuel mixture is ignited to produce a flame in the combustion chamber;

a first set of tubes located within the housing, wherein the firetube end wall extends and opens to the first set of tubes, the first set of tubes extending longitudinally from and parallel with the fire tube and extending longitudinally from the fire tube end wall a remaining portion of the length between the first and second walls of the housing to and through the second wall of the housing;

a second set of tubes located above and in parallel with a portion of the fire tube and a portion of the first set of tubes, the second set of tubes generally spanning the length extending between the first and the second walls of the housing; and a chamber providing a space between and connecting the first and second sets of tubes;

wherein a flow of heated combustion gases is sequential such that the heated combustion gases flow from the fire tube directly to and through the first set of tubes, and then directly to and through the chamber space, and then directly to and through the second set of tubes, before the heated combustion gases are discharged from the boiler; and wherein the heated combustion gases that are discharged from the boiler comprise emissions that are characterized as low NOx emissions having 9 ppmv or less $NO_x$ formation.

2. The boiler system of claim 1, wherein the fire tube includes a shell structure comprising a generally cylindrical shape having a circumference and the first set of tubes extends in-line with the fire tube.

3. The boiler system of claim 1, wherein the housing includes a circumference and the second set of tubes extends at least partially around a shell structure.

4. The boiler system of claim 3, wherein a schematic vertical plane passing through a center of the housing also passes through a center of the fire tube and the first and second sets of tubes are each positioned generally symmetrically on either side of the vertical plane.

5. The boiler system of claim 4, wherein at least one of: (a) none of the tubes of the second set of tubes extend in a region or location that is below the fire tube; and (b) none of the tubes of the second set of tubes extend in a region or location that is below the first set of tubes.

6. The boiler system of claim 4, wherein none of the tubes of the second set of tubes extend in a region or location that is between the fire tube and a bottom of the cylindrical housing.

7. The boiler system of claim 1, wherein the second set of tubes and the first set of tubes are submerged in water.

8. The boiler system of claim 7, wherein either: (a) water is provided within the housing to a water level, providing open space to remain within the housing and permitting the boiler to be configured for steam applications; or (b) water is provided within the housing so that the housing is filled with water and the boiler is configured for hot water applications.

9. The boiler system of claim 1, wherein either: (a) water is provided within the housing to a water level, providing space open space to remain within the housing and permitting the boiler to be configured for steam applications, or (b) water is provided within the housing so that the housing is filled with water and the boiler is configured for hot water applications.

10. The boiler system of claim 1, wherein the burner is integrally formed with the housing.

11. The boiler system of claim 1, wherein air is provided with the air-fuel mixture and such air is provided from a single source.

12. The boiler system of claim 1, wherein, within the chamber, there is no device that is configured to close any portion or end of any of the tubes in the first set of tubes or any of the tubes in the second set of tubes.

13. The boiler system of claim 1, wherein, within the chamber, there is no device that is configured to reverse the flow of any portion of the heated gases in any of the tubes in the first set of tubes, or any of the tubes in the second set of tubes.

14. The boiler system of claim 1, wherein the fuel is natural gas.

15. The boiler system of claim 1, wherein the air is directed through the air passage towards a damper that selectively provides the air for the air-fuel mixture, the combustion air fan being located between the air inlet and the damper.

16. The boiler system of claim 1, further comprising a damper at the air inlet that is configured to open and close the air inlet to selectively provide air flow.

17. The boiler system of claim 1, wherein the heated combustion gases are discharged from the boiler through an exhaust outlet that is adjacent to the front housing.

18. The boiler system of claim 1, further comprises a water outlet through which water exits the boiler system, and a water inlet through which water is replenished into the boiler system, that water inlet and water outlet both being located in a top of the boiler system housing.

* * * * *